US005640983A

United States Patent [19]

Sherman, Jr. et al.

[11] Patent Number: 5,640,983

[45] Date of Patent: Jun. 24, 1997

[54] TANK CLEANING DEVICE

[75] Inventors: George L. Sherman, Jr., Kingwood; Daniel G. Elko, Fulshear, both of Tex.

[73] Assignee: Butterworth Systems, Inc., Houston, Tex.

[21] Appl. No.: 597,701

[22] Filed: Feb. 5, 1996

[51] Int. Cl.[6] ..... B08B 9/08

[52] U.S. Cl. ..... 134/167 R; 134/181; 134/172; 239/240; 239/243; 239/263.3

[58] Field of Search ..... 134/167 R, 172, 134/181, 201, 179, 176; 239/240, 243, 261, 263.3

[56] References Cited

U.S. PATENT DOCUMENTS

| | | | |
|---|---|---|---|
| 1,557,240 | 10/1925 | Butterworth . | |
| 2,766,054 | 10/1956 | Joyslen | 299/18 |
| 2,766,065 | 10/1956 | Joyslen . | |
| 2,917,243 | 12/1959 | Lione | 239/227 |
| 3,255,969 | 6/1966 | Saad | 239/227 |
| 3,275,241 | 9/1966 | Saad | 239/227 |
| 3,326,468 | 6/1967 | Bristow et al. | 239/227 |
| 3,373,927 | 3/1968 | Miller | 230/116 |
| 3,584,790 | 6/1971 | Bonfield | 239/227 |
| 3,625,425 | 12/1971 | Robinson | 239/227 |
| 3,630,645 | 12/1971 | Eheim | 417/420 |
| 3,854,664 | 12/1974 | Hunter | 239/206 |
| 4,065,234 | 12/1977 | Yoshiyuki et al. | 417/420 |
| 4,115,040 | 9/1978 | Knorr | 417/420 |
| 4,120,618 | 10/1978 | Klaus | 417/420 |

(List continued on next page.)

FOREIGN PATENT DOCUMENTS

| | | | |
|---|---|---|---|
| 0084342B1 | 1/1987 | European Pat. Off. . | |
| 2000099 | 8/1969 | France . | |
| 2153500 | 4/1973 | France . | |
| 1186442 | 4/1970 | United Kingdom | 3/2 |
| 2096455 | 10/1982 | United Kingdom | 9/8 |
| WO81/01727 | 6/1981 | WIPO . | |
| WO88/09874 | 12/1988 | WIPO . | |
| WO91/16150 | 10/1991 | WIPO . | |
| WO92/06297 | 4/1992 | WIPO . | |
| WO93/07388 | 4/1993 | WIPO . | |
| WO94/13955 | 6/1994 | WIPO . | |

OTHER PUBLICATIONS

Article entitled "Seal–Less Magnetic Drive Pumps" from March Catalog #F0960 R1 of the March Manufacturing Co., 1983, pp. 1–5.

Articles form Series 13A entitled "Magnet Drive —Gear Pumps"; Positive Displacement —Gear Pump; and Leak–Free —Magnet Drive from brochure Micropump a publication of Micropump Corporation.

(List continued on next page.)

*Primary Examiner*—Frankie L. Stinson

[57] ABSTRACT

A fluid driven tank cleaning device is provided. The device includes an inlet that connects to a source of cleaning solution under pressure and a stem coupled to the inlet having a fluid receiving chamber. A hermetically sealed gear box is also provided which is coupled to the stem and has a secondary chamber separated from the receiving chamber by a common wall. A primary drive shaft rotatably mounted within the fluid receiving chamber is driven by an impeller which rotates in response to fluid entering the fluid receiving chamber. The primary drive shaft is magnetically coupled to a secondary drive shaft rotatably mounted within the secondary chamber. A gear train reduces the speed of the secondary shaft. A first output shaft rotatably mounted within the secondary chamber is connected to the secondary drive shaft via the gear train. The output shaft is magnetically coupled to a second output shaft which rotates a main housing relative to the stem about a first axis. A fluid nozzle assembly rotatably mounted to the main housing about a second axis is also provided. The fluid nozzle assembly is fluidly connected to the fluid receiving chamber and discharges the cleaning solution out of the tank cleaning device in a high speed spray. The inlet, the stem, the hermetically sealed gear box, the main housing and the fluid nozzle assembly are all formed of an aliphate polyketone.

24 Claims, 4 Drawing Sheets

U.S. PATENT DOCUMENTS

| | | | |
|---|---|---|---|
| 4,135,253 | 1/1979 | Reich et al. | 3/1.7 |
| 4,844,707 | 7/1989 | Kletschka | 417/420 |
| 5,092,523 | 3/1992 | Rucker et al. | 239/240 |
| 5,127,796 | 7/1992 | Nakao et al. | 417/420 |
| 5,201,642 | 4/1993 | Hinckley | 417/420 |
| 5,253,986 | 10/1993 | Bond et al. | 417/420 |
| 5,302,091 | 4/1994 | Horiuchi | 417/420 |

OTHER PUBLICATIONS

Article regarding LaBour/Texel MK Series Magnetic Drive Centrifugal Chemical Pumps published by Pumpsall, Inc.

Articles regarding Tuthill Corporation's Magnetically Coupled Gear Pumps, 1983, pp. 2–5, 7,9–11, 18–21.

Article entitled "Internal Cleaning of Tanks System TWK from Uraca Pumpenfabrik Urach", West Germany.

March Mfg. Co. Seal–Less Magnetic Drive Pumps 1–5 1983.

Micropump Corp. Series 13A Magnetic Drive —Gear Pumps; Positive Displacement —Gear Pump; Leak–Free —Magnet Drive.

Pumpsall, Inc. LaBour/Texel MK Series Magnetic Drive Centrifugal Chemical Pumps.

Tuthill Corp. Tuthill Magnetically Coupled Gear Pumps 2–5, 7,9–11, 18–21 1983.

Uraca Pumpenfabrik Urach Internal Cleaning of Tanks System TWK.

TANK CLEANING DEVICE

FIELD OF THE INVENTION

This invention relates generally to tank cleaning devices and more particularly to an improved tank cleaning device formed of a polyketone material and having a hermetically sealed gear box and two pairs of magnetic couplings.

BACKGROUND OF THE INVENTION

The petrochemical, food, and beverage processing industries use a variety of process, transportation, and storage vessels which must be periodically cleaned. Typically, such vessels or tanks are cleaned by a tank cleaning device which uses the cleaning fluid being sprayed within the tank to drive the nozzle spray assembly in a predetermined pattern. A device of this type generally includes a primary drive shaft which is connected to an impeller at an inlet end and connected at the other end to a gear box. The device includes a receiving chamber which receives high pressure fluid entering into the device and a separate secondary chamber which is defined by the gear box. As the high speed cleaning solution enters the inlet section of the tank cleaning device it flows through the impeller causing it to rotate, in turn rotating the primary drive shaft.

The gear box includes a series of gears which reduce the high speed input from the primary drive shaft to a low speed output. This reduction can be as great as 1000:1. The main housing of the tank cleaning device is connected to the output of the gear box and rotates relative to the gear box about a center axis along which the cleaning solution enters the device. The cleaning solution exits the device through a pair of opposing nozzles which rotate in a plane parallel to the center axis as the main housing of the tank cleaning device is rotated about the center axis. The spray pattern thus generated covers an infinite surface area, i.e., an outwardly projecting spherical spray pattern is thus created.

There are two basic tank cleaning devices of the above-described type. One type of tank cleaning device employs a sealed gear box. In this device, a high speed seal is provided in the wall between the receiving chamber and the gear box through which the primary shaft passes. A lubricant such as oil is provided in the gear box for keeping the gears lubricated and thus reducing the wear on the gears. A drawback of this type of tank cleaning device, however, is that due to the high speed rotation of the primary shaft, and the often severe chemical nature of the cleaning solution being passed through the device, the seal and bearing tend to wear out rapidly, requiring frequent replacement. Thus, the repair and replacement of such seals have become important factors in the maintenance of such devices.

The second type of tank cleaning device is known as a flow through device. In this device, the gear box is not sealed. Rather, the cleaning solution is allowed to flow through the gear box. In this type of device, the tank cleaning solution acts as the lubricant for the gears. Because tank cleaning solutions are poor lubricants, the gears in this type of tank cleaning device wear out much more frequently than the gears in devices employing a sealed gear box and thus require frequent repair and/or replacement. This latter type of tank cleaning device is typically used to clean tanks in the food and beverage industries which are under strict FDA (Food and Drug Administration) regulations to provide a sterile environment for the food or beverage being contained within the tank.

Because the seals in the tank cleaning devices employing a sealed gear box usually ultimately fail, the oil from these gear boxes leaks into the receiving chamber and thus can contaminate the cleaning solution. Therefore, the tank cleaning devices of the sealed gear box type are not typically used for cleaning tanks used in the food and beverage industry. It is desirable to provide a tank cleaning device for the food and beverage industry which requires little or no maintenance and does not contaminate the cleaning solution.

U.S. Pat. No. 5,092,523 proposes a solution to the problem of oil leaking into the receiving chamber. In this solution, oil is prevented from leaking into the receiving chamber by separating the gear box from the primary drive shaft. This is accomplished by providing a wall between the receiving chamber and the gear box. The torque from the primary drive shaft is transmitted to a secondary shaft in the gear box through a magnetic coupling which couples the primary shaft to the secondary shaft without physically connecting the shafts. Thus, the opening which is typically formed in the gear box to accommodate the drive shaft is sealed in this device so that no oil can leak out of the gear box in the location of the primary shaft. However, oil may still leak out of the gear box in this device. The output shaft of the gear box, which is coupled to the main housing and allows the main housing to rotate relative to the gear box, is sealed to the gear box with an O-ring which can fail and thus create a source of leakage.

A further drawback of known tank cleaning devices is that they are very heavy and thus difficult for tank cleaning personnel to transport. Typical tank cleaning devices weigh between 35 and 50 lbs. This is because the main housing and most of the other components of these devices are formed of bronze or steel. These materials have traditionally been used in these devices because they are strong, chemically resistant and heat resistant. Bronze is also conductive which is important especially for tank cleaning devices which are used in the petrochemical industry.

The carbon atoms in petrochemicals carry a positive charge. If these atoms are excited they can create an electrical current which unless grounded can be dangerous to tank cleaning personnel. The impact by the high velocity cleaning solution on oil residue in a tank being cleaned, for example, can excite the charge in the carbon atoms to the point of creating an electrical current. This current is conducted through the metal housing of the tank cleaning devices, through the steel fibers reinforcing the solution supply hose coupled to the tank cleaning device to ground. It is desirable to reduce the overall weight of tank cleaning devices while at the same time maintain the strength, chemical resistance, heat resistance and conductive properties of known steel devices.

The present invention is directed to overcoming or at least minimizing some of the problems mentioned above.

SUMMARY OF THE INVENTION

In accordance with one aspect of the present invention, a fluid driven tank cleaning device is provided. The device includes an inlet that connects to a hose or drop pipe which supplies cleaning solution under pressure and a stem coupled to the inlet. The stem has a fluid receiving chamber and a discharge outlet which discharges the cleaning solution out of the stem into a flow channel which directs the solution into a fluid nozzle assembly. The fluid nozzle assembly in turn discharges the solution out of the tank cleaning device in a spherical spray pattern.

A body bevel gear is also provided which connects the stem to a completely hermetically sealed gear box. The hermetically sealed gear box defines a secondary chamber which is separated from the receiving chamber by a common wall. The hermetically sealed gear box prevents materials from seeping into or out of the secondary chamber. A primary drive shaft rotatably mounted within the fluid receiving chamber is driven by an impeller which rotates in response to fluid entering the stem. The primary drive shaft is magnetically coupled to a secondary drive shaft rotatably mounted within the secondary chamber. A gear train reduces the speed of the secondary shaft by a factor of approximately 1000:1. A first output shaft rotatably mounted within the secondary chamber is connected to the secondary drive shaft via this gear train. The first output shaft is magnetically coupled to a second output shaft which is coupled to a main housing and causes the main housing to rotate relative to the stem about a first axis.

The inlet, the stem, the hermetically sealed gear box, the main housing and the fluid nozzle assembly are all formed of an aliphate polyketone embedded with graphite nanofibers.

In accordance with another aspect of the present invention, a gear assembly including a hermetically sealed housing is provided for use in a variety of applications. The gear assembly includes an input shaft adapted to be magnetically coupled to an external drive shaft and an output shaft adapted to be magnetically coupled to an external driven shaft. The gear assembly further has means connected to the input shaft and the output shaft for changing the rotational speed of the output shaft relative to the input shaft.

BRIEF DESCRIPTION OF THE DRAWINGS

Other aspects and advantages of the present invention will become apparent upon reading the following detailed description and upon reference to the drawings in which.

DETAILED DESCRIPTION OF THE PREFERRED EMBODIMENTS

Figure 1:
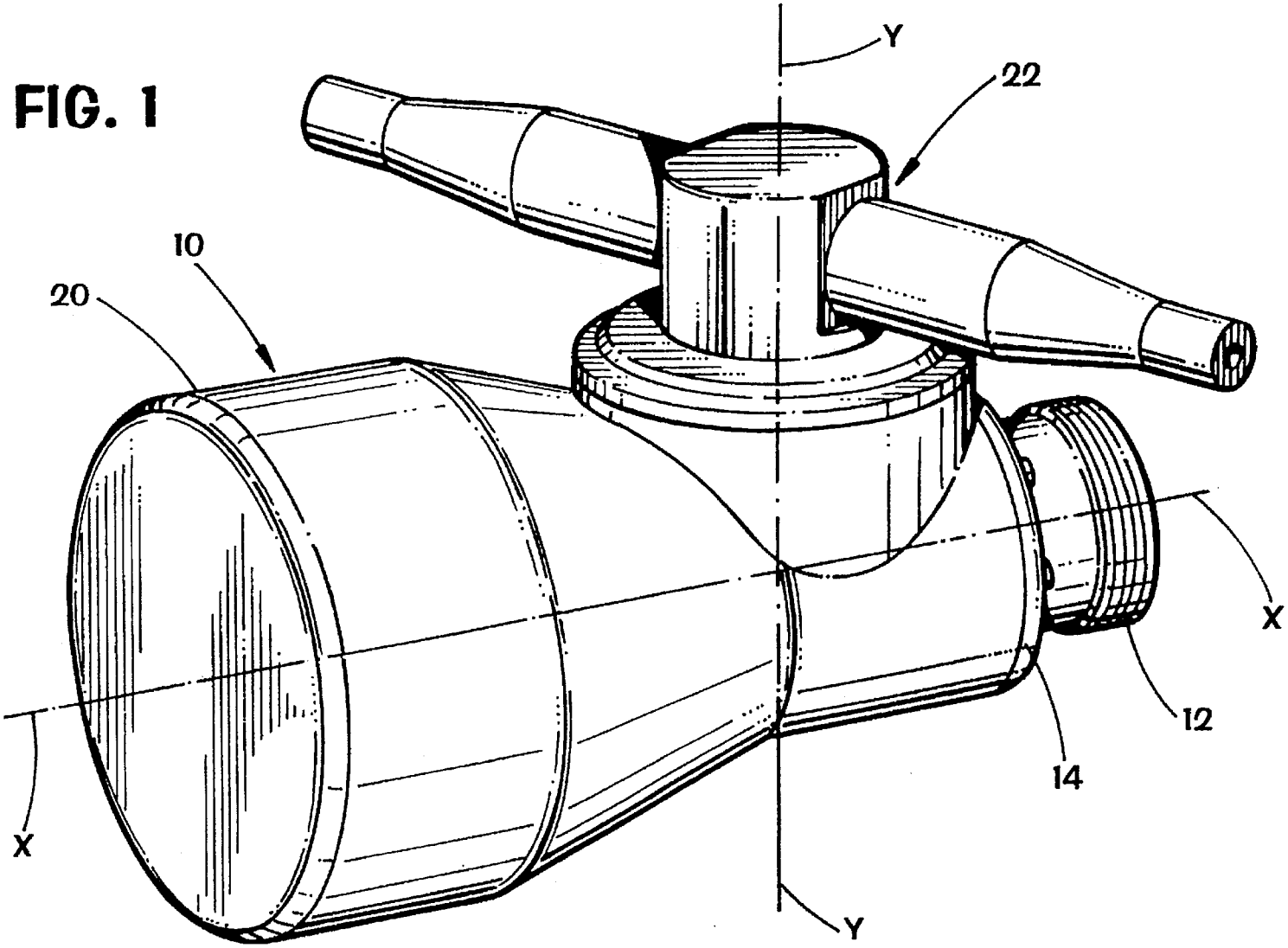
FIG. 1 is a perspective view of a tank cleaning device according to the present invention.
Figure 2:
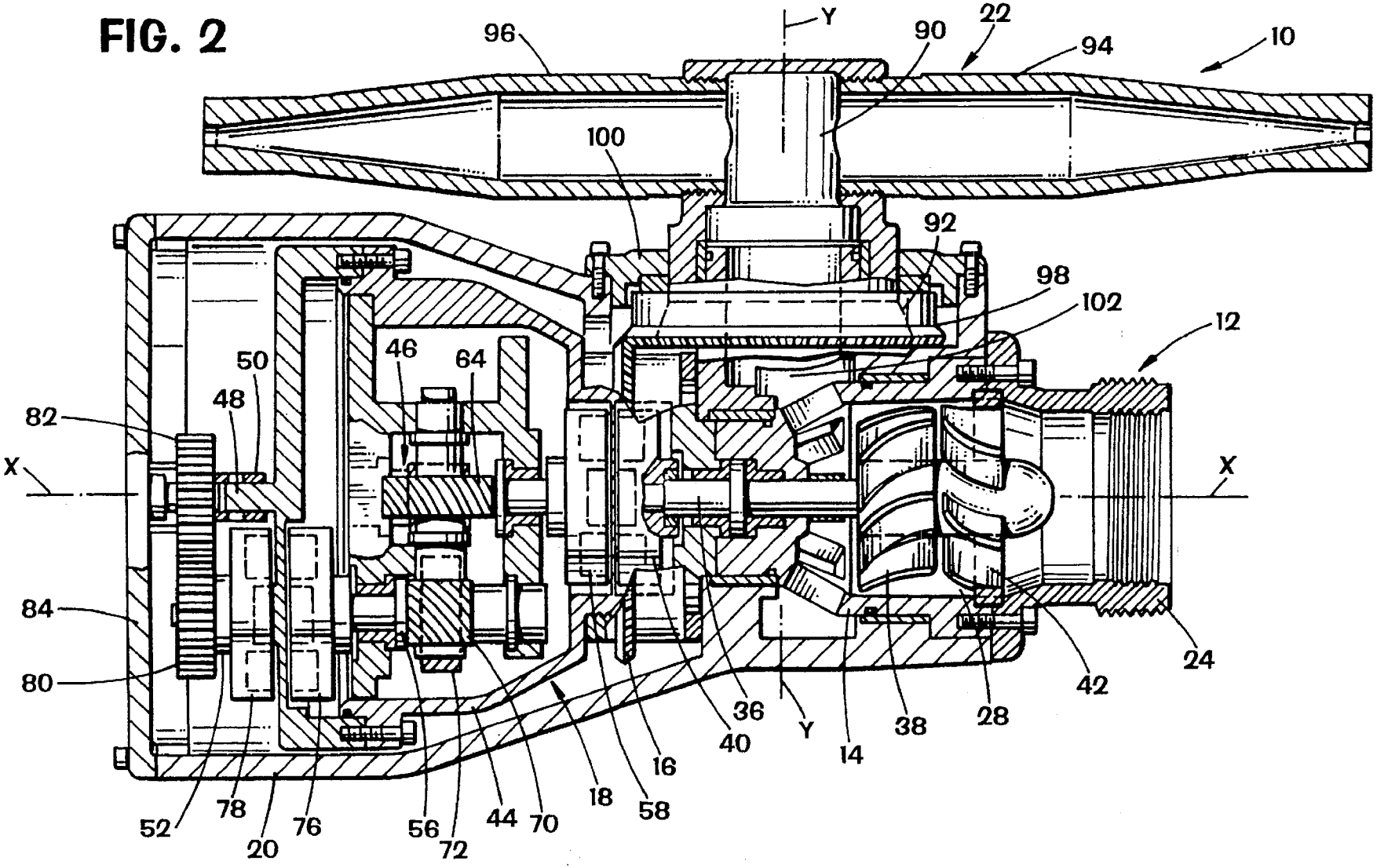
FIG. 2 is a cross-sectional view of the tank cleaning device shown in FIG. 1.

Turning now to the drawings and referring initially to FIGS. 1 and 2, a tank cleaning device according to the present invention is shown generally by reference numeral 10. The device includes an inlet 12, a stem 14, a body bevel gear 16, a gear box 18, a main housing 20 and a nozzle assembly 22.

The inlet 12 is a generally cylindrical member having an inlet end and an outlet end. The inlet end is defined by a threaded coupling 24 which is threaded both on its inner diameter and its outer diameter. The threaded coupling 24 is provided for connecting the tank cleaning device 10 to a solution supply hose (not shown). The inlet 12 is mounted to the stem 14 at the outlet end with a plurality of mounting bolts, as shown in FIG. 2.

Figure 3:
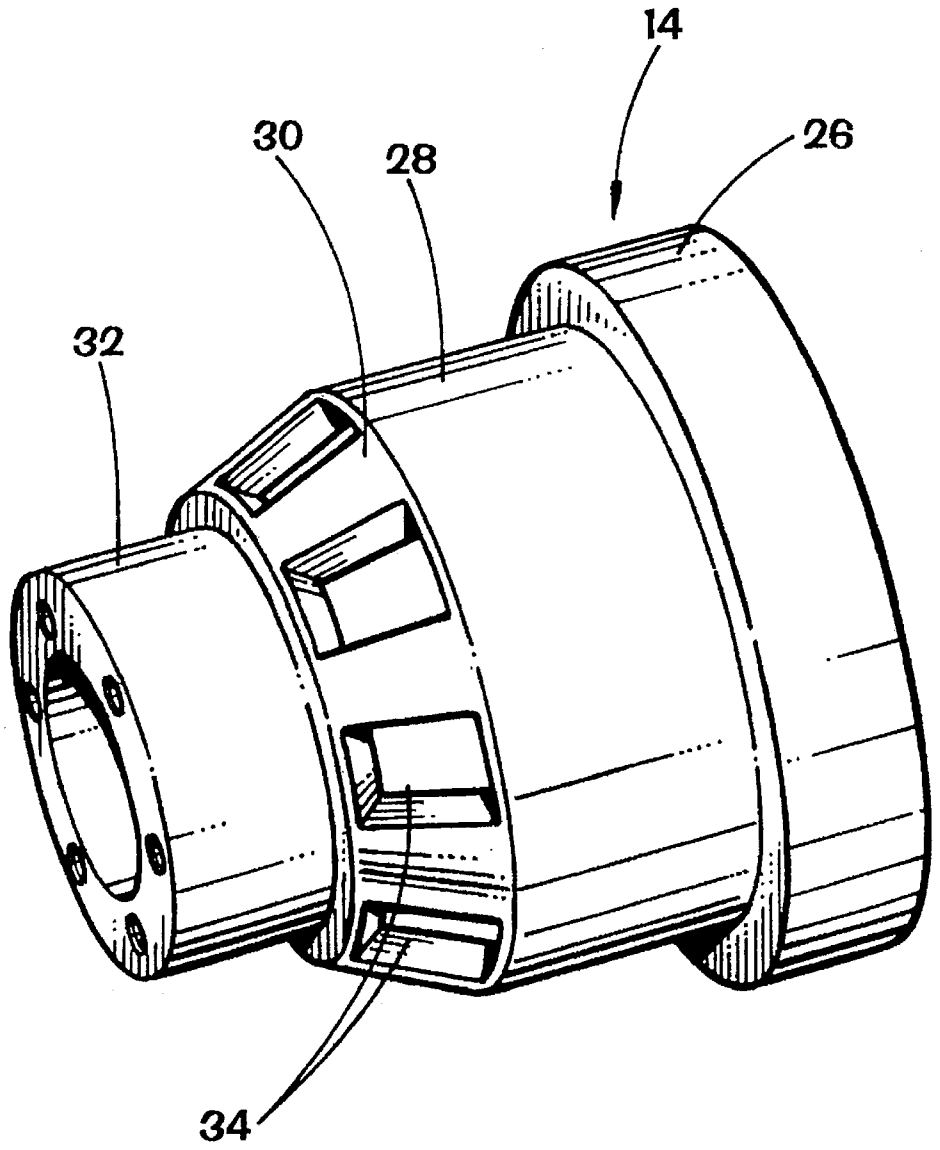
FIG. 3 is a perspective view of the stem portion of the tank cleaning device shown in FIG. 1.

The stem 14 has four sections: an inlet mounting hub 26, a fluid receiving chamber 28, a fluid discharge outlet 30 and a bevel gear mounting hub 32, as shown in FIG. 3. The inlet mounting hub 26 is provided for mounting the inlet 12 to the stem 14. It has a plurality of threaded mounting bores, preferably eight, which are provided for receiving a corresponding plurality of mounting bolts which are used to attach the inlet 12 to the stem 14. The fluid receiving chamber 28 is a generally cylindrically shaped member and is the region where the cleaning solution enters the tank cleaning device 10. It is also the region where the drive means for the tank cleaning device 10 is disposed as further explained below. The fluid discharge outlet 30 is a generally conically-shaped member having a plurality of discharge outlets 34 which direct the tank cleaning solution into the nozzle assembly 22 as further explained below. The bevel gear mounting hub 32 is provided for mounting the body bevel gear 16 to the stem 14. It has a plurality of threaded mounting bores, preferably eight, which are provided for receiving a corresponding plurality of mounting bolts which are used to attach the body bevel gear 16 to the stem 14.

The drive means for rotating the tank cleaning device is disposed within the fluid receiving chamber 28. It includes a primary drive shaft 36 having an input end and an output end, an impeller 38, a magnetic coupling hub 40 and an inlet guide vane 42, as shown in FIG. 2. The impeller 38 is attached to the primary drive shaft 36 at the input end in the manner known in the art and the magnetic coupling hub 40 is attached to the primary drive shaft 36 at the output end using a washer and cap screw.

The impeller 38 is defined by a circular disk having a plurality of equally spaced curve-shaped vanes disposed on its outer surface. The vanes redirect the flow of the high speed cleaning fluid being directed into them, in so doing they cause the impeller 38 to rotate which in turn rotates the drive shaft 36.

Figure 4:
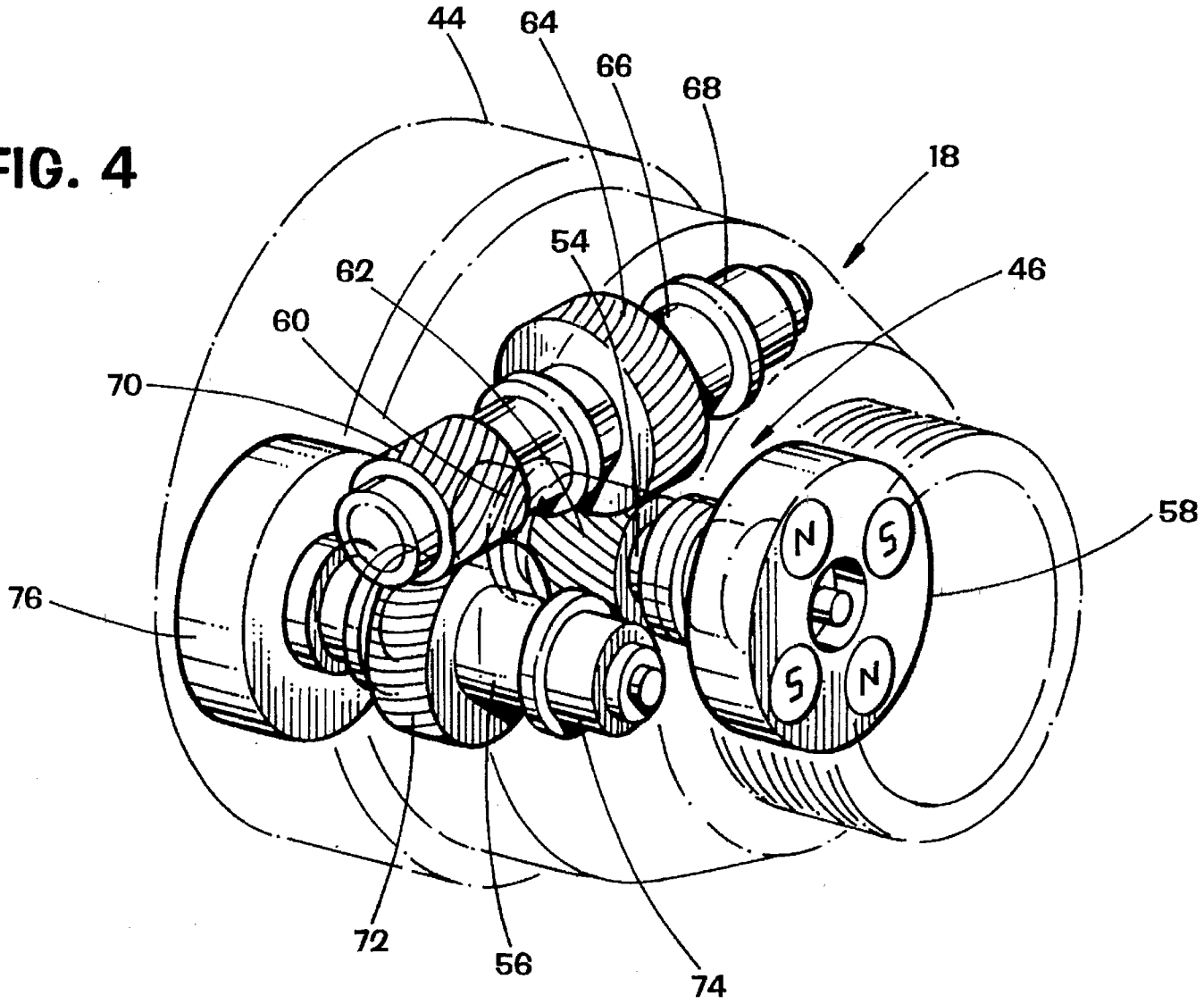
FIG. 4 is a partial perspective view of the hermetically sealed gear box used in the tank cleaning device shown in FIG. 1.

The magnetic coupling hub 40 is defined by a disk-shaped member having a plurality of magnetic elements embedded in it. Preferably, there are four (4) magnets embedded in the disk defining the magnetic coupling hub 40 which are equally spaced 90° apart from one another, as shown in FIGS. 2 and 4.

The inlet guide vane 42 is defined by a circular disk having a plurality of equally spaced curve-shaped vanes which direct the high speed fluid entering the fluid receiving chamber 28 into the vanes of the impeller 38 at an angle which optimizes the torque being imparted to the impeller by the fluid. The inlet guide vane 42 is an optional component which may be omitted if the torque imparted to the impeller 38 by the undirected flow of the fluid flowing into the receiving chamber 28 is sufficient to turn the main housing 20 at the desired speed as will be further explained below.

The body bevel gear 16 is mounted to the stem 14 using a plurality of bolts. The body bevel gear 16 is a generally cylindrically shaped member having a plurality of teeth disposed along its mid-section on its outer surface.

The gear box 18 is defined by a housing 44 which encases a gear train 46. The housing 44 is adapted to be mounted to the body bevel gear 16. The housing 44 has a centering member 48 which fits into an output shaft 50 which drives the main housing 22, as shown in FIG. 2. The centering member 48 centers the gear box 18 within the main housing 22. The housing 44 further includes an outwardly projecting shaft 52 which is parallel to the centering member 48.

The gear box defines a hermetically sealed inner chamber which is filled with a lubricant such as oil. It is designed to be a removable unit which can be easily taken out of the tank cleaning device 10 for repair or replacement.

The gear train 46 includes an input shaft 54 and an output shaft 56, as shown in FIGS. 2 and 4. The output shaft 56 is parallel to the input shaft 54. Both the input shaft 54 and the output shaft 56 are preferably formed on stainless steel. A magnetic coupling hub 58 is mounted to the input shaft 56 at one end with a washer and cap screw. The magnetic coupling hub 58 is defined by a disk-shaped member having four equally spaced magnets embedded therein, as shown in FIG. 4. The magnetic coupling hub 58 is preferably formed of stainless steel. The magnets are disposed 90° apart from one another and are preferably formed of rare earth materials, e.g., neodymium iron boron, or samarium cobalt.

A graphite-filled teflon bearing 60 is mounted to the input shaft at the other end. A worm 62 preferably formed of stainless steel is also mounted to the input shaft 54 between the magnetic coupling hub 58 and the bearing 60. The worm 62 meshes with a worm gear 64 mounted to an intermediate shaft 66. The worm gear 64 is preferably formed of bronze. The intermediate shaft 66 is perpendicular to both the input shaft 54 and the output shaft 56. A graphite-filled teflon bearing 68 is mounted to one end of the intermediate shaft 66 adjacent to worm gear 64.

A second worm 70 which is preferably formed of stainless steel is mounted to the other end of the intermediate shaft 66 adjacent to the worm gear 64. The second worm 70 meshes with a second worm gear 72 which is preferably formed of bronze and is mounted to the output shaft 56. A graphite-filled teflon bearing 74 is mounted to one end of the output shaft 56 adjacent to the second worm 70. A magnetic coupling hub 76 of the type previously described is mounted to the other end of the output shaft 56 with a washer and cap screw.

The output shaft 56 of the gear train 46 in the gear box 18 is magnetically coupled to a magnetic coupling hub 78 which rotates about outwardly projecting shaft 52. A spur gear 80 is rotatably connected to the magnetic coupling hub 78, as shown in FIG. 2. The spur gear 80 meshes with a spur gear 82 which rotates on the shaft 50 which is connected to an end plate 84 of the main housing 20 and which axially fits over the centering member 48. The magnetic coupling hub 78 is of the type previously described. The spur gears 80 and 82 are preferably formed of bronze.

The main housing 20 rotates relative to the inlet 12, stem 14, body bevel gear 16 and gear box 18 which remain stationary. The main housing 20 rotates about the axis X—X shown in FIG. 1. The fluid nozzle assembly 22 rotates relative to the main housing 20 and is disposed perpendicular to the main housing 20, as shown in FIG. 2. The fluid nozzle assembly 22 rotates about the axis Y—Y, as shown in FIGS. 1 and 2. The axis Y—Y is perpendicular to the axis X—X.

The fluid nozzle assembly 22 is defined by a nozzle body 90 having a conical clutch 92 and two opposing nozzles 94 and 96, each of which is threaded into the nozzle body 90 at opposite ends. A beveled gear 98 having a flanged inner surface fits over, and engages with, the conical clutch 92. The bevel gear 98 is axially slidable relative to the nozzle body 90 and meshes with the bevel gear 16. A plate 100 mounted to the main housing 20 retains the nozzle body 90 so that it connected to the main housing 20 but can rotate relative to it. The plate 100 may be either bolted to the main housing 20 or screwed onto it with threads. Fluid flows into the nozzle assembly 22 from the receiving chamber 28 via a channel 102 formed in the inner surface of the main housing 20.

Preferably, the inlet 12, the stem 14, the gear box 18, the main housing 20 the nozzle body 90 of the nozzle assembly and the opposing nozzles 94 and 96 are all formed of Carilon®, an aliphate polyketone material manufactured by Shell Oil Company. This material is light weight and therefore reduces the overall weight of the tank cleaning device by more than 50% compared to conventional tank cleaning devices. This material is also strong, having a yield strength of 9000 psi, enabling it to withstand high fluid pressures, good ductility having a notched izod impact strength of 4.0 ft-lb/in (foot pounds per inch), and excellent chemical resistance. As is known in the art, there are several different scales for rating chemical resistance. Some of these scales include, e.g., Excellent, Satisfactory, and Unsatisfactory; A–D; where A indicates an excellent chemical resistance, and D indicates a chemical resistance that is not suitable; and 1–5, where 1 indicates that the material is fully resistant and 5 indicates that the material is not resistant. Aliphate polyketone rates an excellent, A, or 1 for most chemicals. In particular, it is resistant to corrosion from the elements in the cleaning environment as well as the cleaning solution itself. Furthermore, apliphate polyketone has a good heat resistance, i.e., it will maintain its physical properties below approximately 300° F. Aliphate polyketone is also moderately priced at approximately $3.85 per/lb. Lastly, because all the components made out of the aliphate polyketone material can be injection molded, the cost of manufacturing the tank cleaning device 10 is greatly reduced.

The primary components of conventional tank cleaning devices are made of either machined bronze or stainless steel parts, and therefore are very expensive to manufacture. A good alternative virgin plastic material is PEEK (polyetheretherkeytone). PEEK has many of the same favorable physical properties as aliphate polyketone, i.e., a yield strength of 15,200 psi, ductility having a notched izod impact strength of 1.6 ft-lb/in, an excellent, A or 1 rated chemical resistance for most chemicals, and a heat resistance of 500° F. However, it is less desirable than aliphate polyketone because it costs approximately $40.00 per/lb.

Preferably, the aliphate polyketone material is embedded with 5% graphite nano-fibers manufactured by the Hyperion Corporation. The graphite nano-fibers make those components of the tank cleaning device formed out of the polyketone material conductive (which is important for the reasons discussed above) without making those components stiff which tends to happen to plastic materials which are embedded with most other forms of carbon graphite.

The operation of the tank cleaning device 10 according to the present invention will now be discussed. First, tank cleaning solution enters the tank cleaning device 10 through the inlet 12 at a high velocity. The solution then flows into the fluid receiving chamber 28 in the stem 14. The cleaning solution then exits the stem 14 through the outlet ports 34 in the discharge outlet 30. The channel 102 directs the cleaning solution discharged from the stem 14 into the fluid nozzle assembly 22. As the high speed cleaning solution impacts the top of the nozzle body 90 of the nozzle assembly 22, the nozzle assembly is pushed outward relative to main housing 20 thereby causing the conical clutch 92 to engage with the bevel gear 98 which in turn engages with the bevel gear 16. The high speed cleaning solution then exits the fluid nozzle assembly 22 through the nozzles 94 and 96 in two opposing streams.

As the high speed solution enters the receiving chamber 28 it passes through the inlet guide vane 42 which directs it into the curve-shaped vanes of the impeller 38 thereby causing the impeller to rotate. As the impeller 38 rotates the primary drive shaft 36 rotates which in turn rotates the magnetic coupling hub 40. The magnetic force from the magnetic coupling hub 40 is imparted to the magnetic coupling hub 58 which in turn causes the input shaft 54 to rotate. The input shaft 54 in turn rotates the output shaft 56 via the gear train 46. As the output shaft 56 rotates, the magnetic coupling hub 76 in turn is rotated. The rotating magnetic coupling hub 76 in turn imparts a rotational force onto the magnetic coupling hub 78 which in turn rotates the spur gear 80. The rotation of the spur gear 80 causes the intermeshing spur gear 82 to rotate thereby rotating the shaft 50 which in turn rotates the main housing 20. As the main housing 20 rotates about the X—X axis, the fluid nozzle assembly 22 rotates about the Y—Y axis. The rotation of the fluid nozzle assembly 22 about the Y—Y axis occurs as a result of the bevel gear 98 being rotated about the bevel gear 16 which is fixed as the fluid nozzle assembly is being rotated about the X—X axis by the main housing 20.

Those skilled in the art who now have the benefit of the present disclosure will appreciate that the present invention may take many forms and embodiments. Some embodiments have been described so as to give an understanding of the invention. It is intended that these embodiments should be illustrative, and not limiting of the present invention. Rather, it is intended that the invention cover all modifications, equivalents and alternatives falling within the spirit and scope of the invention as defined by the appended claims.

What is claimed is:

1. A fluid driven tank cleaning device, comprising:

an inlet that connects to a source of cleaning solution under pressure;

a stem coupled to the inlet having a fluid receiving chamber;

a hermetically sealed gear box coupled to the stem having a secondary chamber separated from said receiving chamber by a common wall;

a primary drive shaft rotatably mounted within the fluid receiving chamber;

a drive means connected to the primary drive shaft for rotating the primary drive shaft in response to fluid entering the fluid receiving chamber;

a secondary drive shaft rotatably mounted within the secondary chamber, the secondary chamber having a lubricating fluid disposed therein;

a first magnetic drive coupling for magnetically coupling the primary drive shaft to the secondary drive shaft so as to cause the secondary drive shaft to rotate in response to rotation of the primary shaft;

gear reduction means disposed in said secondary chamber and connected to the secondary drive shaft for reducing the rotational speed of the secondary drive shaft;

a first output shaft rotatably mounted within the secondary chamber and connected to the secondary drive shaft through the gear reduction means;

a main housing rotatably mounted to the stem about a first axis;

a second output shaft for rotating the main housing; and a second magnetic drive coupling for magnetically coupling the first output shaft to the second output shaft so as to cause the second output shaft to rotate in response to rotation of the first output shaft and thereby causing the main body to rotate.

2. The fluid driven tank cleaning device according to claim 1, further comprising a fluid nozzle assembly rotatably mounted to the main housing about a second axis, the fluid nozzle assembly being fluidly connected to the fluid receiving chamber and discharging the cleaning solution out of the tank cleaning device in a high speed spray.

3. The fluid driven tank cleaning device according to claim 2, further comprising means for rotating said nozzle assembly about the second axis as the main housing is rotated about the first axis.

4. The fluid driven tank cleaning device according to claim 3, wherein the rotating means includes a pair of intermeshing bevel gears.

5. The fluid driven tank cleaning device according to claim 2, wherein the inlet, the stem, the hermetically sealed gear housing, the main housing, and the nozzle assembly are all formed of aliphatic polyketone material.

6. The fluid driven tank cleaning device according to claim 5, wherein the aliphatic polyketone material is embedded with graphite nano-fibers.

7. The fluid driven tank cleaning device according to claim 1, wherein the first magnetic drive coupling includes a pair of magnetic coupling hubs, one of the pair being mounted to the primary shaft and the other being mounted to the secondary shaft, the pair being disposed face-to-face to one another and being separated by the common wall.

8. The fluid driven tank cleaning device according to claim 7, further comprising an intermediate output shaft disposed between the first output shaft and the second output shaft, the intermediate output shaft and the second output shaft having a pair of intermeshing spur gears.

9. The fluid driven tank cleaning device according to claim 8, wherein the second magnetic drive coupling includes a pair of magnetic coupling hubs, one of the pair being mounted to the first output shaft and the other of the pair being mounted to the second output shaft, the pair of magnetic hubs being disposed face-to-face to one another and being separated by the common wall.

10. The fluid driven tank cleaning device according to claim 9, wherein at least one magnet is embedded in each of the magnetic coupling hubs, and for each pair of magnetic coupling hubs disposed face-to-face the at least one embedded magnets are disposed opposite to one another.

11. The fluid driven tank cleaning device according to claim 10, wherein four magnets are embedded in each of the magnetic coupling hubs in a circular pattern, each magnet being disposed 90° away from an adjacent magnet.

12. The fluid driven tank cleaning device according to claim 1, wherein the gear reduction means includes a first worm mounted to the secondary drive shaft which meshes with a first worm gear mounted on an intermediate gear shaft disposed at a perpendicular angle to the secondary drive shaft, and a second worm mounted to the intermediate gear shaft which meshes with a second worm gear mounted on the first output shaft which is parallel to the secondary drive shaft and perpendicular to the intermediate gear shaft.

13. The fluid driven tank cleaning device according to claim 1, wherein the drive means includes an impeller defined by a plurality of curved-shaped vanes and wherein the main stem further comprises an inlet guide vane which directs the fluid flow directly into the plurality of curved-shaped vanes so as to cause the impeller to rotate at a high velocity.

14. The fluid driven tank cleaning device according to claim 1, further comprising a body bevel gear connecting the stem to the hermetically sealed gear box.

15. A fluid driven tank cleaning device, comprising:

a main housing rotatable about a first axis;

a primary drive shaft;

drive means for rotating the primary drive shaft in response to fluid entering the tank cleaning device;

a hermetically sealed gear box;

a secondary drive shaft disposed within the hermetically sealed gear box;

a first magnetic drive coupling for magnetically coupling the primary drive shaft with the secondary drive shaft so as to cause the secondary drive shaft to rotate in response to rotation of the primary shaft;

a first output shaft rotatably mounted within the hermetically sealed gear box;

gear reduction means connecting the secondary drive shaft to the first output shaft;

a second output shaft for rotating the main housing; and a second magnetic drive coupling for magnetically coupling the first output shaft to the second output shaft so as to cause the second output shaft to rotate in response to rotation of the first output shaft and thereby causing the main body to rotate.

16. The fluid driven tank cleaning device according to claim 15, further comprising an inlet that connects to a source of cleaning solution under pressure and a stem coupled to the inlet having a fluid receiving chamber, the stem being disposed within the main housing and remaining fixed relative to the main housing.

17. The fluid driven tank cleaning device according to claim 16, further comprising a fluid nozzle assembly rotatably mounted to the main housing about a second axis, the fluid nozzle assembly being fluidly connected to the fluid receiving chamber and discharging the cleaning solution out of the tank cleaning device in a high speed spray.

18. The fluid driven tank cleaning device according to claim 17, further comprising means for rotating said nozzle assembly about the second axis as the main housing is rotated about the first axis.

19. The fluid driven tank cleaning device according to claim 18, wherein the rotating means includes a pair of intermeshing bevel gears.

20. The fluid driven tank cleaning device according to claim 16, further comprising a body bevel gear connecting the stem to the gear box.

21. The fluid driven tank cleaning device according to claim 15, wherein the first magnetic drive coupling includes a pair of magnetic coupling hubs, one of the pair being mounted to the primary shaft and the other being mounted to the secondary shaft, the pair being disposed face-to-face to one another and being separated by the common wall.

22. The fluid driven tank cleaning device according to claim 21, wherein the second magnetic drive coupling includes a pair of magnetic coupling hubs, one of the pair being mounted to the first output shaft and the other being mounted to an intermediate output shaft coupled to the second output shaft, the pair being disposed face-to-face to one another and being separated by the gear box.

23. The fluid driven tank cleaning device according to claim 22, wherein four magnets are embedded in each of the magnetic coupling hubs in the first and second magnetic drive couplings.

24. The fluid driven tank cleaning device according to claim 15, wherein the drive means includes an impeller defined by a plurality of curved-shaped vanes and wherein the main stem further comprises an inlet guide vane which directs the fluid flow directly into the plurality of curved-shaped vanes so as to cause the impeller to rotate at a high velocity.

* * * * *